US006386393B1

(12) United States Patent
Paulovich et al.

(10) Patent No.: US 6,386,393 B1
(45) Date of Patent: May 14, 2002

(54) TIPPING RACK FOR BOTTLE

(75) Inventors: John Michael Paulovich, Hewitt; Edward John Giblin, Hopatcong; Michael Lyons, Middlesex, all of NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/474,161

(22) Filed: Dec. 29, 1999

(51) Int. Cl.[7] ..... B67D 5/64

(52) U.S. Cl. ..... 222/166; 248/139; 211/80; 211/81

(58) Field of Search ..... 222/166; 414/421; 211/80, 81; 248/133, 139

(56) References Cited

U.S. PATENT DOCUMENTS

| | | | | |
|---|---|---|---|---|
| 365,851 A | | 7/1887 | Palmer | |
| 548,284 A | | 10/1895 | Atkinson et al. | |
| 1,453,547 A | | 5/1923 | Culver et al. | |
| 1,458,521 A | * | 6/1923 | Castille | 248/139 |
| 2,485,075 A | * | 10/1949 | Szenasi et al. | 248/139 |
| 2,539,094 A | * | 1/1951 | Martinsen | 248/139 |
| 2,549,207 A | | 4/1951 | Kestenbaum | |
| 2,785,836 A | | 3/1957 | Smith et al. | |
| 3,193,150 A | * | 7/1965 | Simas | 222/166 |
| 3,814,293 A | | 6/1974 | Daves | |
| 4,557,399 A | | 12/1985 | Redick, Jr. | |
| 4,844,290 A | | 7/1989 | McCurdy et al. | |
| 5,238,146 A | | 8/1993 | Thorne, Jr. | |

FOREIGN PATENT DOCUMENTS

| | | |
|---|---|---|
| DE | 194 801 | 1/1908 |
| DE | 1 098 841 | 2/1961 |
| FR | 1 023 616 | 3/1953 |
| GB | 2 232 654 A | 12/1990 |
| GB | 2 272 878 A | 7/1994 |
| GB | 2 292 727 A | 3/1996 |
| GB | 2 308 113 A | 5/1997 |

* cited by examiner

*Primary Examiner*—Philippe Derakshani
(74) *Attorney, Agent, or Firm*—Gerard J. McGowan, Jr.

(57) ABSTRACT

A tipping rack, especially for large heavy duty liquid detergent containers. The tipping rack facilitates pouring the last portions of product from the container.

5 Claims, 5 Drawing Sheets

TIPPING RACK FOR BOTTLE

BACKGROUND OF THE INVENTION

With the increased popularity of so-called "club stores" and others which sell products in large unit volumes at discounts, the need to provide packaging for large unit volumes of products has increased. The need for large unit volumes requires that packages be designed which are capable of withstanding greater stresses, such as that resulting from increased weight of product, then has heretofore been the case. Especially is this true of packages for liquid consumer products, such as liquid detergents and liquid fabric softeners.

The arrival of bottles for large unit volumes of liquid detergent, such as 300 oz. bottles, has resulted in a relatively new consumer need, i.e., the need for assistance in pouring from the bottles. For instance, such containers generally need to be tilted at an angle in order to permit dispensing of the last residues of the product. However, due to the weight and bulk of the package and its contents, this is sometimes an inconvenient task.

Palmer, U.S. Pat. No. 365,851 discloses a bottle case. The bottle case includes a fulcrum about which one side turns. One side forms a support for the bottle which is carried with it. A slot or opening is present which is said to leave sufficient space for the contents of the bottle to flow without striking the edge of the support. The bottle is illustrated as slanting downwardly on the support.

Atkinson et al., U.S. Pat. No. 548,284 is directed to an oil can having a carrying handle arranged so that it can be converted into a support on which the can is pivoted. A ratchet bar and ratchet teeth are provided to prevent two parts of the carrying handle from spreading.

Culver et al., U.S. Pat. No. 1,453,547 discloses a barrel holding device.

Kestenabum, U.S. Pat. No. 2,549,207 discloses a fluid dispensing container having a supporting casing and a valve.

Smith et al., U.S. Pat. No. 2,785,836 is directed to a liquid dispenser and a casing therefor.

Daves, U.S. Pat. No. 3,814,293 discloses a dispensing rack for use with quart or king size bottles of beverages. The rack supports the bottle in an inclined position and is suitable to be placed on a shelf in a conventional refrigerator. A valve assembly cooperates with the rack to secure the bottle in place.

Redick, Jr., U.S. Pat. No. 4,557,399 is directed to an adapter for bottled water dispensing.

McCurdy et al., U.S. Pat. No. 4,844,290 is directed to a fluid dispensing apparatus which includes a support stand having a vertical support member for supporting the bottle at an angle with respect to the horizontal.

Thorne, Jr., U.S. Pat. No. 5,238,146 is directed to a support device for insertion beneath the portion of one end of a drum configured for stable engagement with a chime or a groove so that the drum may be reliably and securely supported in a tilted position for an extended period of time to facilitate emptying of residue therefrom.

Despite the various inclined stands in the art, there is still a need for a practical stand for permitting tipping of a heavy container such as a jumbo heavy duty liquid container, and particularly one permitting dispensing from various inclined positions.

SUMMARY OF THE INVENTION

In a first embodiment, the present invention concerns a tipping rack for inclining a heavy duty liquid bottle or other consumer package at up to a 45° angle or more in order to permit all or substantially all of the liquid product to be dispensed from the package. In another embodiment, the invention comprises a bottle for liquid consumer products including a spigot, in combination with a tipping rack capable of supporting a container at various inclined angles.

In one embodiment, the tipping rack includes a package receiving base, a pivot at one end of the package receiving base, a protrusion for engaging steps at another end of the base, a tipping rack base in contact with the pivot, and at least one step associated with, and spaced vertically from, the rack base. Preferably the rack comprises a plurality of steps associated with and spaced vertically from the rack base. In another embodiment, the tipping rack comprises a pair of support rods extending between two support blocks, and two or more pivotable rods, connected to each other at least one end, the rods receiving one of the support rods in apertures. The rods are pivotable from a first position where they do not rest on the second support rod to a second position where they rest on the second support rod and are able to support the large container.

In another embodiment, the invention includes a bottle supported on a support frame which is held at an inclined angle to the horizontal by one or more support beams. The support frame and the support beams are each pivotable at one end in association with a base frame which is generally disposed parallel to the horizontal.

In still another embodiment a bottle is inclined on one or more attached support blocks which may also include a support beam and a support frame forming structure.

For a more complete understanding of the above and other features and advantages of the invention, reference should be made to the following detailed description of preferred embodiments and to the accompanying drawings.

DETAILED DESCRIPTION OF THE INVENTION

Figure 1:
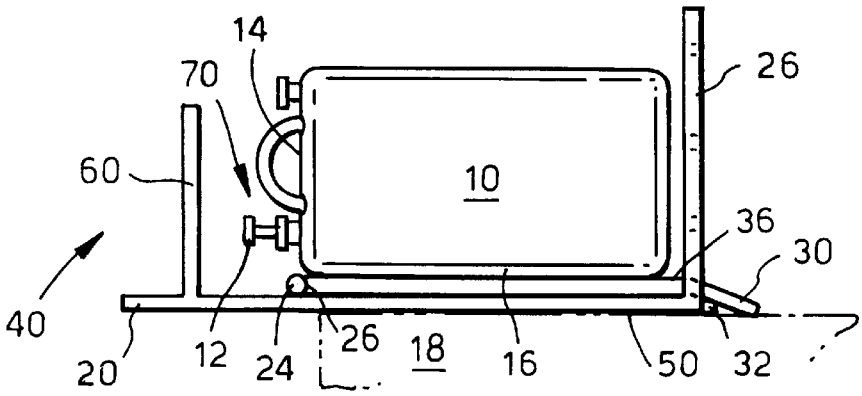
FIG. 1 is a side elevational view of a tipping rack and package of the invention, supported on a horizontal base.
Figure 2:
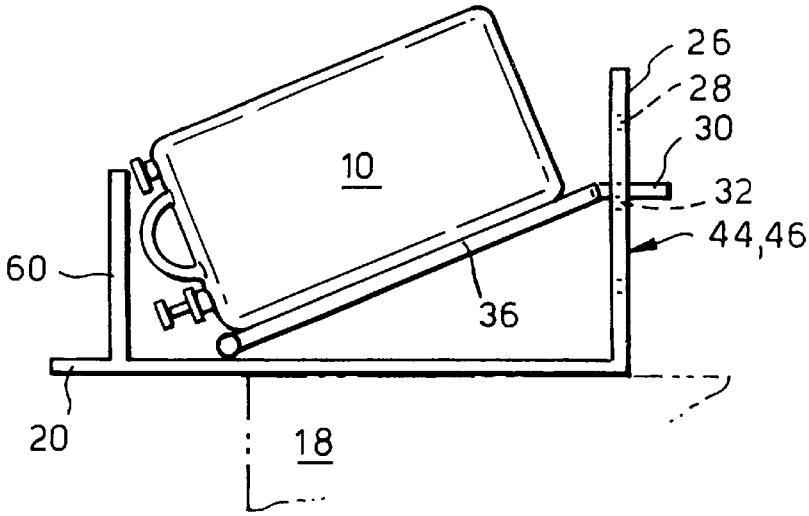
FIG. 2 shows the combined tipping rack and package of FIG. 1 wherein the package is disposed at an angle to the horizontal base.
Figure 3:
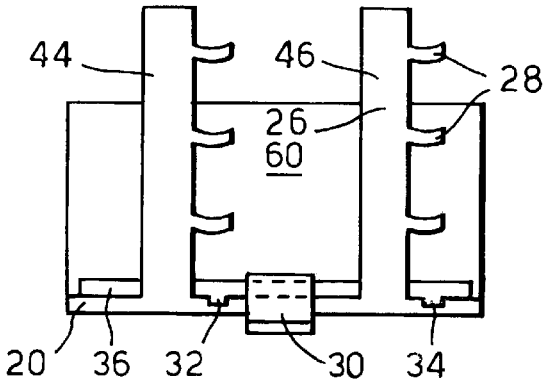
FIG. 3 is a rear view of the tipping rack of the invention without the package.

Package 10 is preferably a bottle for liquid consumer products, such as heavy duty liquid detergents or liquid fabric softeners. Bottle 10 is supported on tipping rack 40 which includes package receiving base 36, pivot 24, and rack base 20 in contact with the pivot. Extending upwardly from rack base 20 are ladders 44, 46, each of which include steps 28. Protruding from the rear of package receiving base 36 are protrusions 32, 34 which are positioned so as to be received on corresponding steps 28 of ladders 24, 26. Also extending from the rear of package receiving base 36 is handle 30.

Rack base 20 rests on the top horizontal surface 50 of table 18. At the front end of rack 40 is restraining wall 60 which extends upwardly from rack base 20. Restraining wall 60 may be wide or narrow, depending on the weight of the bottle.

Pivot bar 24 is received within cylinders 26 on either side of the package. Tolerances are lenient so that pivot bar 24 may slide laterally within cylinders 26, for purposes which will be explained hereinafter. Cylinders 24 may be disposed above and attached to base rack 20 or in which case it is preferred that base 36 rests on base 20. Alternatively, cylinders 24 may be formed within base 20 in which case rack base 36 may rest on surface 18.

Bottom wall 16 of package 10 may be provided with a surface etching or an abrasive material to prevent or minimize sliding with respect to package support base 36. Alternatively, or in addition, the upper surface of package support base 36 may be provided with etching or an abrasive material to minimize sliding. Support base 36 may comprise a frame, as illustrated in FIGS. 1–3 and 8 or may be plainer. There the base is a frame, the etching or abrasive material may be placed on the top surface of the frame, as at 70, 72. Where the base 36 is plainer, the etching or abrasive material may be more centrally disposed if desired.

In operation, the consumer initially dispenses product by depressing button 70 on spigot 12. Product then flows freely from the package. When it becomes difficult to dispense product, i.e., when product will not flow or flows at an unacceptably slow rate, the consumer may grasp handle 30 and raise it, thereby inclining package support base 36 at an angle to the upper surface 50 of table 18. When handle 30 reaches the desired height, the handle is moved laterally so that protrusions 34 at the rear of package support surface 36 are supported by one level of steps 28. This retains the package in the inclined position. Also, retaining wall 60 prevents or impedes forward motion of the package. When the dispensing of product has again slowed to an unacceptable rate, the package may be elevated further by lifting handle moving it laterally to the right to disengage the protrusions 34 from steps 28 lift it further vertically and then move handle 30 laterally to the left to engage protrusions 34 with steps 28 at a higher level.

The package is preferably made of high density polyethylene (HDPE). The rack may be made of a metal such as steel or aluminum, e.g., wires, rods, etc. or may be made of a polymeric material such as polypropylene or HDPE.

When the handle is raised, pivot bar 24 rotates within cylinders 26 on either side of the package support base. Tolerance is provided in the accommodation of pivot bar 24 within cylinders 26 to permit the lateral movement necessary to disengage protrusions of steps 28 and to reengage protrusions with steps at a higher or lower level as desired.

The invention permits a consumer readily to raise and dispense a heavy heavy-duty liquid container such as a 300 fluid ounce container.

Figure 4:
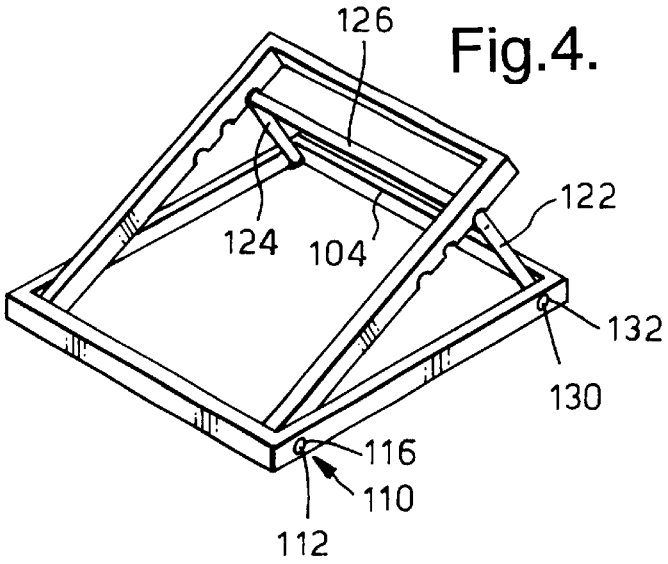
FIG. 4 is a perspective view of an alternative rack which can be used in the invention.
Figure 5:
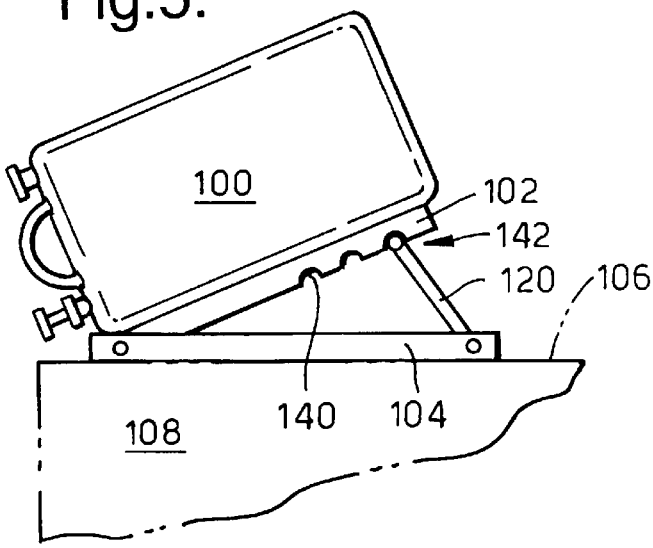
FIG. 5 is a side elevational view of the rack of FIG. 4 with a bottle resting thereon at an angle.

In the alternative embodiment of FIGS. 4 and 5, bottle 100 rests upon bottle receiving base 102. Base 102 pivots within rack base 104, which rests on general horizontal surface 106 of table 108. Pivot 110 is formed by knobs 112 which are accommodated within cylinder apertures 116 of rack base 104.

Figure 9:
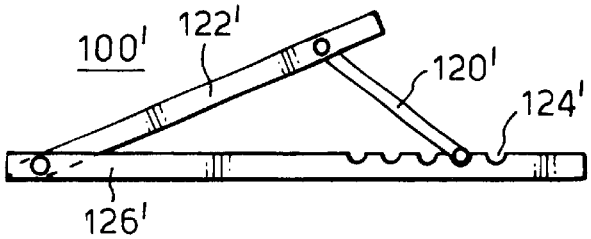
FIG. 9 is a side elevational view of an alternative embodiment of the rack of FIG. 4.

Package receiving base support 120 comprises arm 122, 124 connected by cross bar 126. Arms 122, 124 include, at ends opposite cross bar 126, knobs 130 which are accommodated within cylindrical openings 132 in rack base 104. The underside of bottle receiving base 102 includes recesses 140 which accommodate an end 142 of support 120 whereby package receiving base 102 is locked into an inclined position by support bar 120. Where support 120 includes cross bar 126, the recess on the underside of package receiving base 102 will be sized as to accommodate cross bar 126. In the embodiment of FIG. 9, support 120' pivots within the frame of bottle receiving support 122' and its opposite end is received within apertures 124' of rack base 126'.

Figure 6:
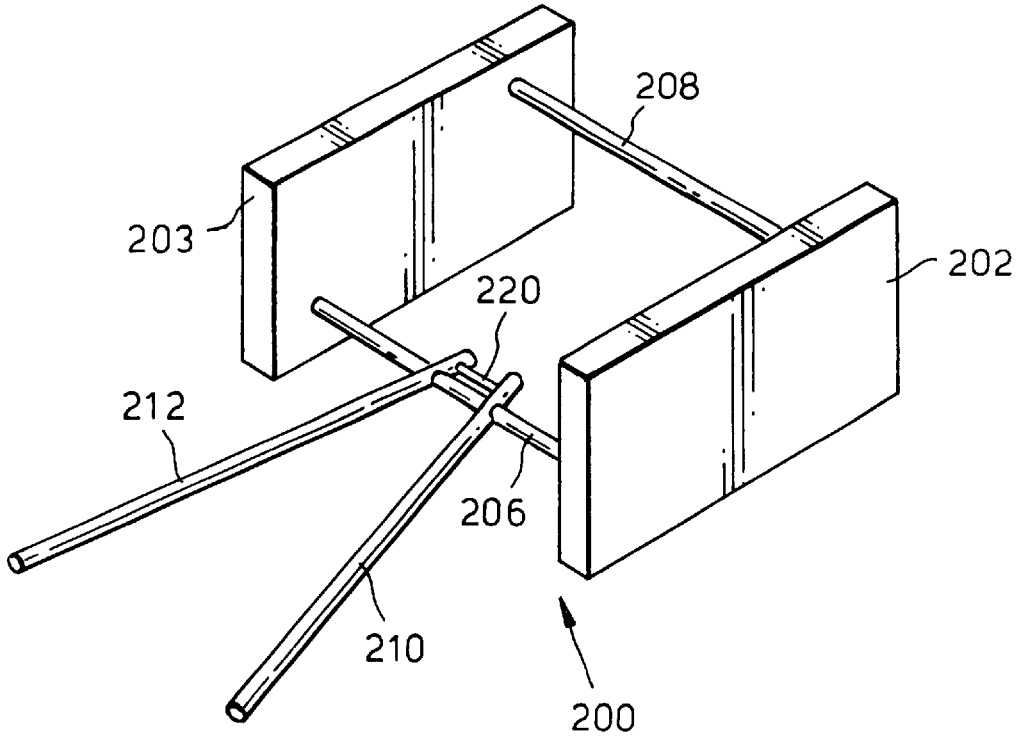
FIG. 6 is a top perspective view of an alternative rack for the invention.
Figure 7:
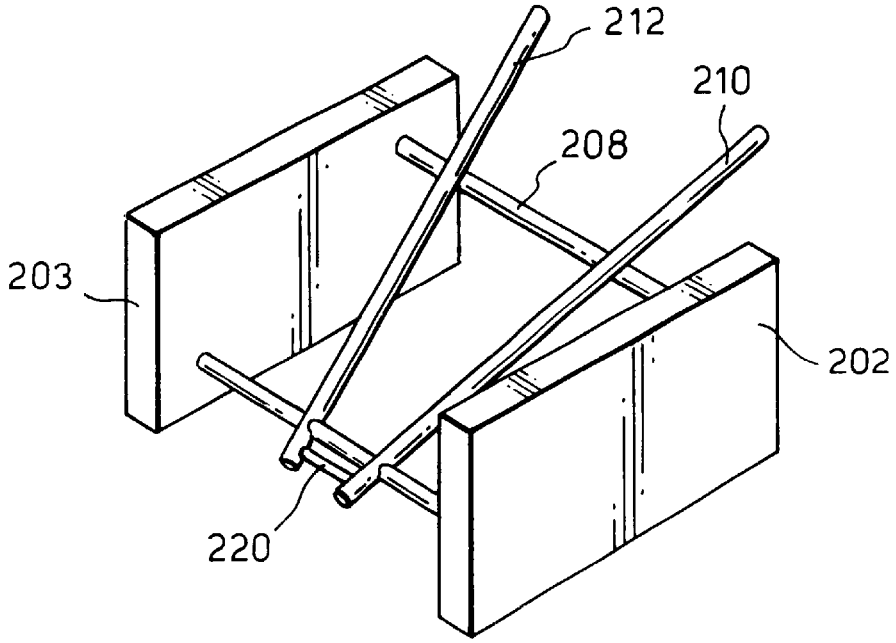
FIG. 7 is a top perspective view of the rack of FIG. 6 except that the rods are in the supporting position.
Figure 8:
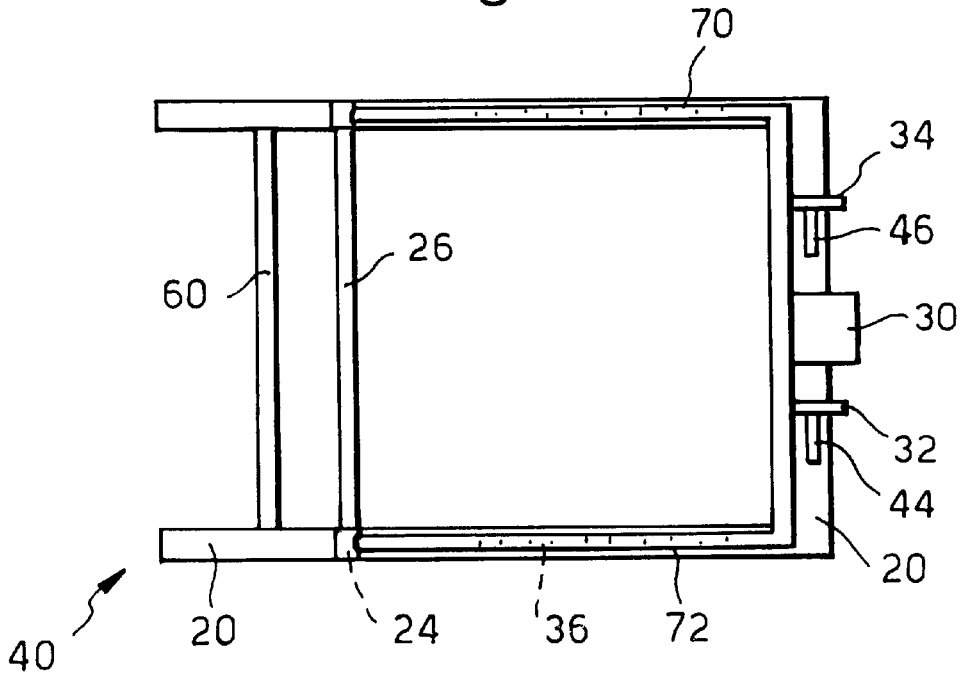
FIG. 8 is a top plan view of the tipping rack of the invention illustrated in FIGS. 1–3, without the bottle.

A still further embodiment is illustrated in FIGS. 6 and 7. Tipping rack 200 includes a pair of support blocks 202, 203 connected by a first cross beam 206. A second cross beam likewise extends through and connects blocks 202, 203, but at a higher elevation than cross beam 206. The bottoms of blocks 202, 203 will be disposed generally horizontally and the elevation of beam 208 relative to beam 206 is relative to the horizontal.

Beam 206 extends through openings in base beams 210, 212. Beams 206, 208, 210 and 212 may be of any suitable shape, for instance rods. Cylindrical openings in beams 210 and 212 may accommodate beam 206 if beam 206 is cylindrical. Beams 210, 212 are connected by connecting rod 220 which extends between beams 210 and 212 thereof.

Beams 210, 212 are rotatable from a first position shown in FIG. 6 wherein the beams are not in contact with supporting rod 208 to a second position shown in FIG. 7 wherein they are supported by beam 208. Due to the elevation of beam 208 with respect to beam 206, the support of beams 210, 212 on beam 208 together with their association with beam 206 results in beams 210, 212 being disposed at an incline relative to the horizontal. For instance, the angle may be, as with other tipping racks of the present invention, up to 45° or more, preferably from 20 to 45°. Model 230 is shown in phantoms resting on beams 210, 212. Beams 210, 212 may be retained in the relative positions shown respectively in FIGS. 6 and 7 by close tolerances or they may be urged to the FIG. 6 position by a spring so that force would be required to bring them to the FIG. 7 position and the force exerted by the weight of the bottle would retain them in the FIG. 7 position.

Figure 10:
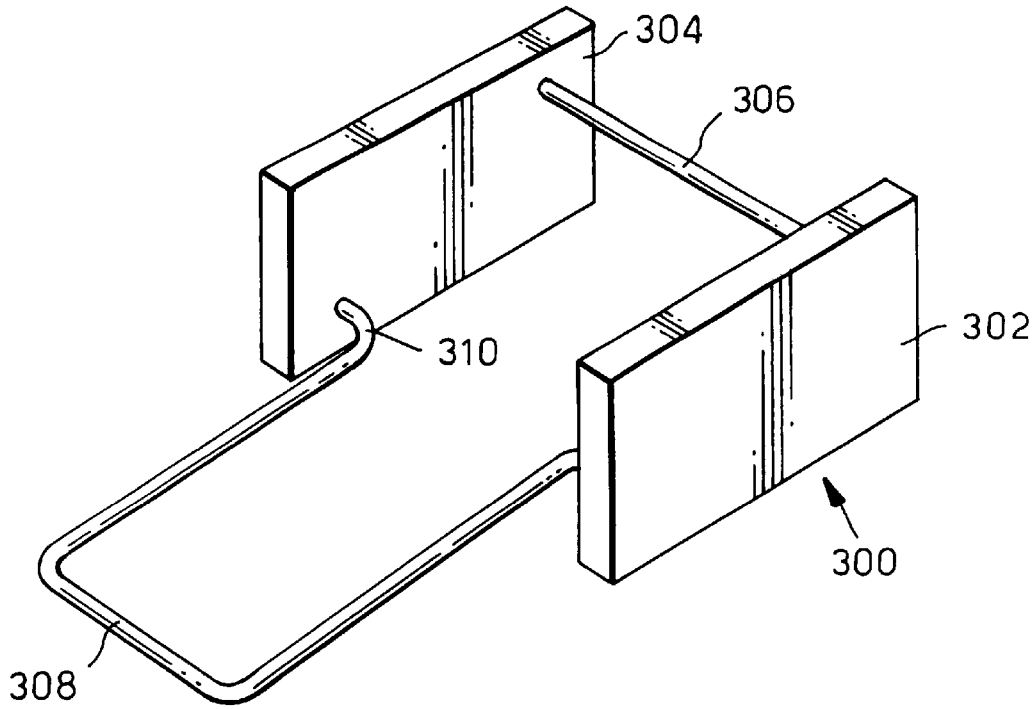
FIG. 10 is a perspective view of an alternative embodiment.
Figure 11:
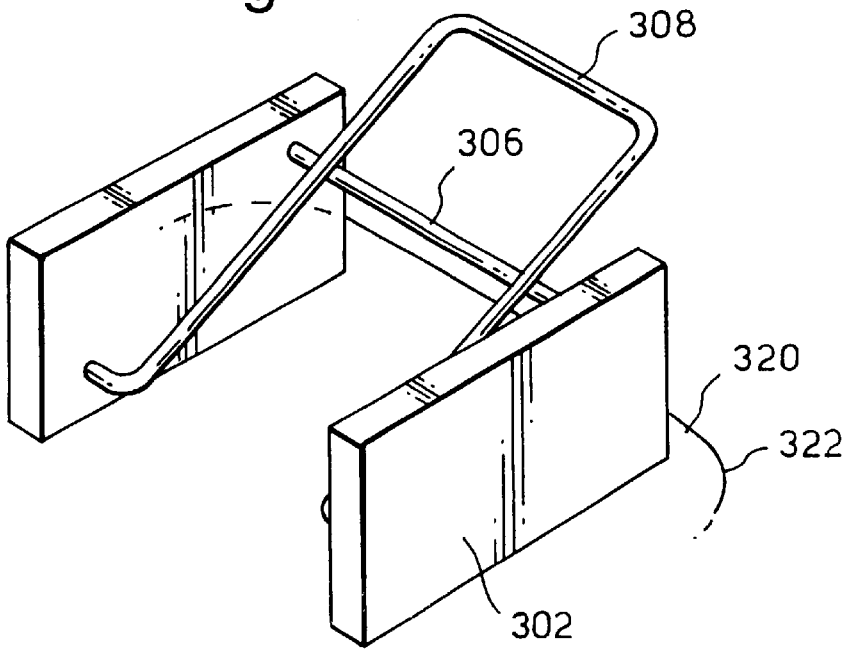
FIG. 11 is a perspective view of the rack of FIG. 10 wherein the support plane forming structure is in the supporting position.

In FIGS. 10 and 11 are illustrated a support rock which can be attached to and made part of a container. As seen in FIG. 10 rack 300 includes support blocks 302, 304. Extending between support blocks 302, 304 is support beam 306 which may comprise wire, plastic rod, metal rod or other suitable objects. At a lower elevation than rod 306 is support plane defining structure 308. In the FIG. 10 embodiment support plane defining structure comprises a rod which has been shaped to form a U with ends which turn inwardly into the support blocks. Ends 310 of support plane defining structure 308 pivot within support blocks 302, 304.

Support blocks 302, 304 may be adhered to the surface 320 of a wall of bottle 322, as seen in FIG. 11. Wall 320 may be adjacent a wall in which is disposed a dispensing opening, which may include a valve or spigot.

Figure 12:
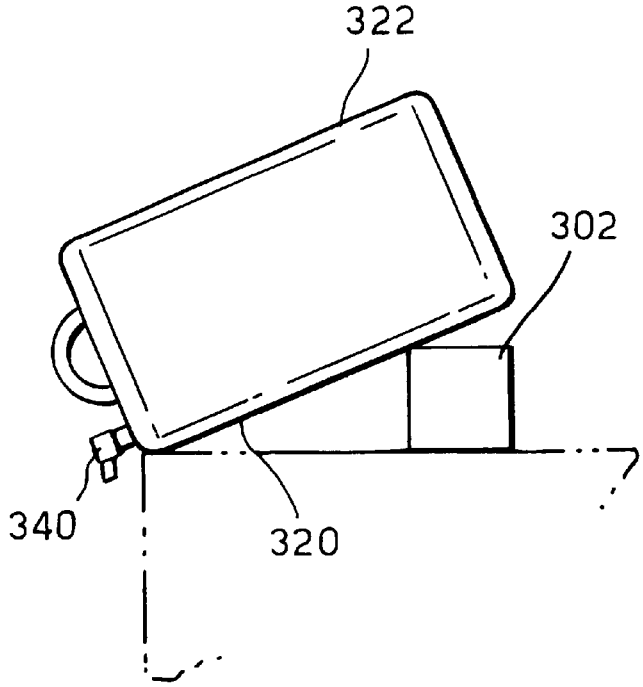
FIG. 12 is a side elevational view of a bottle which is elevated by support blocks.

Upon dispensing, bottle 322 rests on wall 320 and support block 302, 304. The presence of support blocks extending from wall 320, by themselves, results in a slight incline with respect to the horizontal as seen in FIG. 12. When dispensing even at this angle becomes difficult, support plane forming structure 308 may be pivoted so that it rests against support bar 306, thus providing even further elevation to one end of wall 320 and thereby providing even further angle to the dispensing of product by spigot 340.

It should be understood, of course, that the specific forms of the invention herein illustrated and described are intended to be representative only as certain changes may be made therein without departing from the clear teachings of the disclosure. Accordingly reference should be made to the following appended claims in determining the full scope of the invention.

What is claimed is:

1. A combination tipping rack and package comprising (i) a tipping rack including a) a package-receiving base;

b) a pivot at one end of said package-receiving base;

c) a step-engaging protrusion on another end of said base;

d) a rack base in contact with said pivot; and e) at least one step associated with and spaced vertically from said rack base; and (ii) a package comprising a package base, and a pouring wall having a pouring opening therein, said package base and pouring wall being adjacent said package base being disposed upon said rack base.

2. A bottle support rack comprising a pair of support blocks, a first beam extending between said blocks, a support plane defining structure extending between said support blocks, said support plane defining structure being movable between a first position and a second position wherein in said second position said first beam supports said bottle.

3. A combined bottle support rack and bottle comprises the rack of claim 2 adhered to a side wall of a bottle.

4. The combined bottle support rack and bottle of claim 3 wherein said side wall is adjacent a wall having a product dispensing opening.

5. The combined rack and bottle according to claim 4 wherein said dispensing opening includes a spigot.

* * * * *